United States Patent [19]

Blikken et al.

[11] Patent Number: 5,069,693

[45] Date of Patent: Dec. 3, 1991

[54] SYSTEM FOR AREA POLLUTION CONTROL

[76] Inventors: Wendell A. Blikken; Wayne C. Blikken, both of 952 S. Grove Rd., Ypsilanti, Mich. 48198

[21] Appl. No.: 601,450

[22] Filed: Oct. 23, 1990

[51] Int. Cl.[5] ..... B01D 46/00; B01D 47/02

[52] U.S. Cl. ..... 55/220; 55/68; 55/94; 55/302; 55/213; 55/385; 55/525; 404/2; 4/2

[58] Field of Search ..... 55/74, 76, 78, 94, 96, 55/97, 302, 68, 385.1; 404/2, 4, 213, 217, 271, 274, 220, 525

[56] References Cited

U.S. PATENT DOCUMENTS

| | | | |
|---|---|---|---|
| 1,224,448 | 5/1917 | Davidson | 404/4 |
| 1,966,996 | 7/1934 | Rafferty | 404/4 |
| 3,731,459 | 5/1973 | Foster | 55/94 |
| 3,791,752 | 2/1974 | Gardner | 404/2 |
| 3,828,525 | 8/1974 | Copa et al. | 55/68 |
| 3,844,737 | 10/1974 | Macriss et al. | 55/78 X |
| 3,898,059 | 8/1975 | Foster | 55/94 |
| 4,838,732 | 6/1989 | Clark et al. | 404/2 X |

*Primary Examiner*—Charles Hart

*Attorney, Agent, or Firm*—Barnes, Kisselle, Raisch, Choate, Whittemore & Hulbert

[57] ABSTRACT

A system for collecting and purifying polluted air over a large geographic area where surface level water channels are used for rainfall drainage. The water channels are covered to render them air passages as well, and air jet engines draw the polluted air from the areas to a purifying station where debris is separated and the polluted air is passed to purifying units before being discharged from the station. The water channels may be covered to provide lineal parks or roadways for light traffic. Also, sewage passages may be incorporated in the system to provide greater area coverage and reduce noxious fumes.

4 Claims, 7 Drawing Sheets

SYSTEM FOR AREA POLLUTION CONTROL

FIELD OF INVENTION

Pollution control using in situ storm drainage channels as collector passages for polluted air.

BACKGROUND AND OBJECTS OF THE INVENTION

The air pollution problems in many metropolitan areas due to industrial emissions and vehicular exhaust emissions is of great concern to residents of these areas. Various solutions have been suggested such as smaller engines in passenger vehicles, better emission control of engine exhausts, and possible ride sharing to reduce the overall number of vehicles traveling in rush hour traffic. The metro complex surrounding Los Angeles, Calif. is especially plagued with this problem of smog overlying the city. This due in part to the hills surrounding the city which trap and retain the polluted atmosphere and the absence of winds which would otherwise move the air out of the area.

The Los Angeles area, in contrast to other large cities, has many open drain channels which collect and direct water resulting from rain storms to a suitable location for dispersion. It has been noted that a period of rain in the area will clear the air temporarily and the rain absorbs the air pollution and carries it off to the ocean, rivers, or collection basins.

It is proposed to incorporate the open drain channels of an area, such as Los Angeles, in one or more pollution control systems which will move polluted air at ground level to one or more purification installations where the air may be cleaned and discharged.

BRIEF DESCRIPTION OF THE AIR POLLUTION CONTROL SYSTEM

This system will include top covers for the various storm drains which allow drainage water to enter during the rain periods but will also pull air from areas near expressways and other sources of pollution. This air is pulled in by creating a low pressure zone in the covered drain channels using a highly powered aircraft type jet engine, a turboprop type, or other appropriate engine driving a suction fan. The recovered air is passed through a revolving disc screen filter which extracts any entrained particles and refuse which is then collected in a suitable bin. The air then passes into a purifier using a suitable combination of electrostatic, chemical, absorptive, and other techniques before ultimately being discharged to the atmosphere. The power control for the system will be computerized for optimum operation with various input data, of pollution levels, wind conditions and other parameters including cost/benefit estimates.

The main object of the invention is then to utilize the existing surface drain channels to collect and move polluted air into a processing zone where it is cleared of entrained material and purified for return to the local environment.

Other objects and features of the invention will be apparent in the following description and claims in which the principles of the invention are set forth together with details to enable persons skilled in the art to apply the principles and techniques of the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
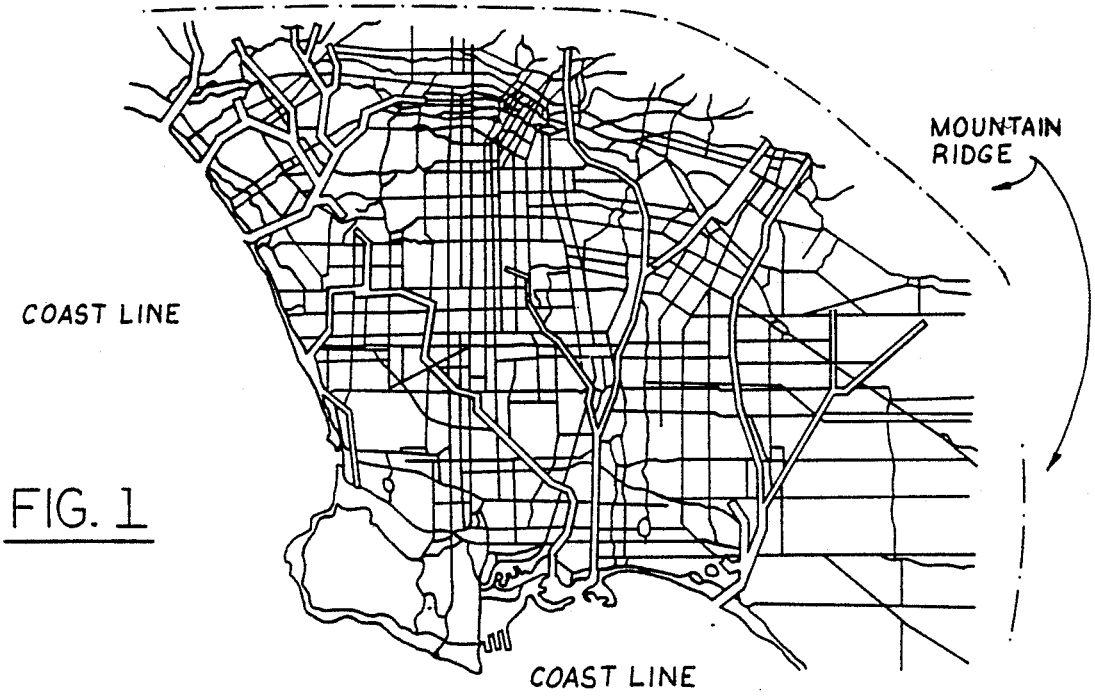
FIG. 1, a view of a metropolitan area showing rivers and streets and mountain ridges.
Figure 2:
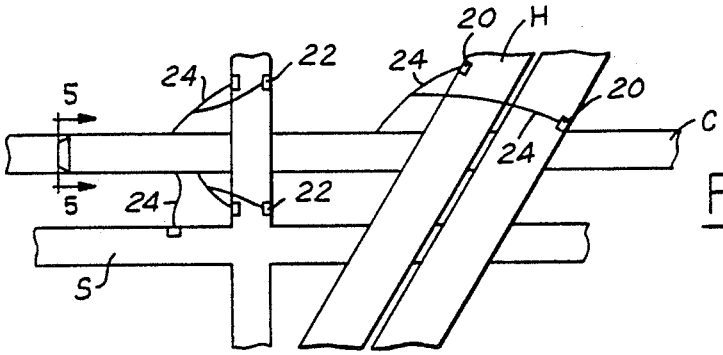
FIG. 2, a segmental view of streets and drain channels.
Figure 3:
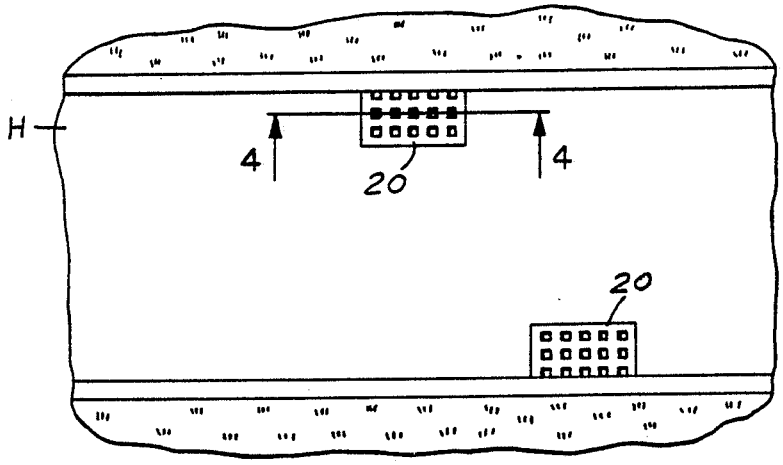
FIG. 3, a plan view of storm drains.
Figure 4:
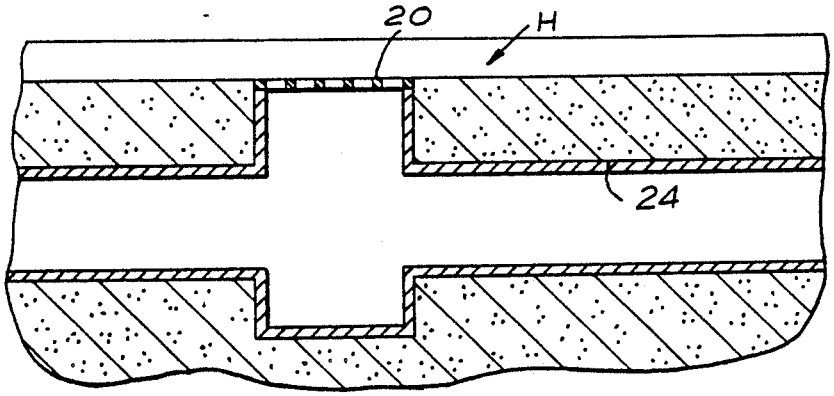
FIG. 4, a sectional view on line 4—4 of FIG. 3 showing a storm drain and channel.

In FIG. 1, a schematic map of an urban area, such as Los Angeles, is illustrated with a coastline, rivers in double lines, mountain ridges shown in dot-dash lines, and streets, highways, and expressways in line designations. In a geographical area, such as Los Angeles, there are numerous networks of underground storm sewers. These empty into major open drain channels which lead either directly to the ocean or to rivers which flow to the coast. In FIG. 2, highway H has drain openings 20 which lead to an open drain channel C. Similarly, a street S has drain grills 22 which lead to the channel C. FIG. 3 illustrates the highway catch basin drain grills 20 in greater detail. FIG. 4 is a sectional view of a highway drain 20 opening to a conduit 24.

Figure 5:
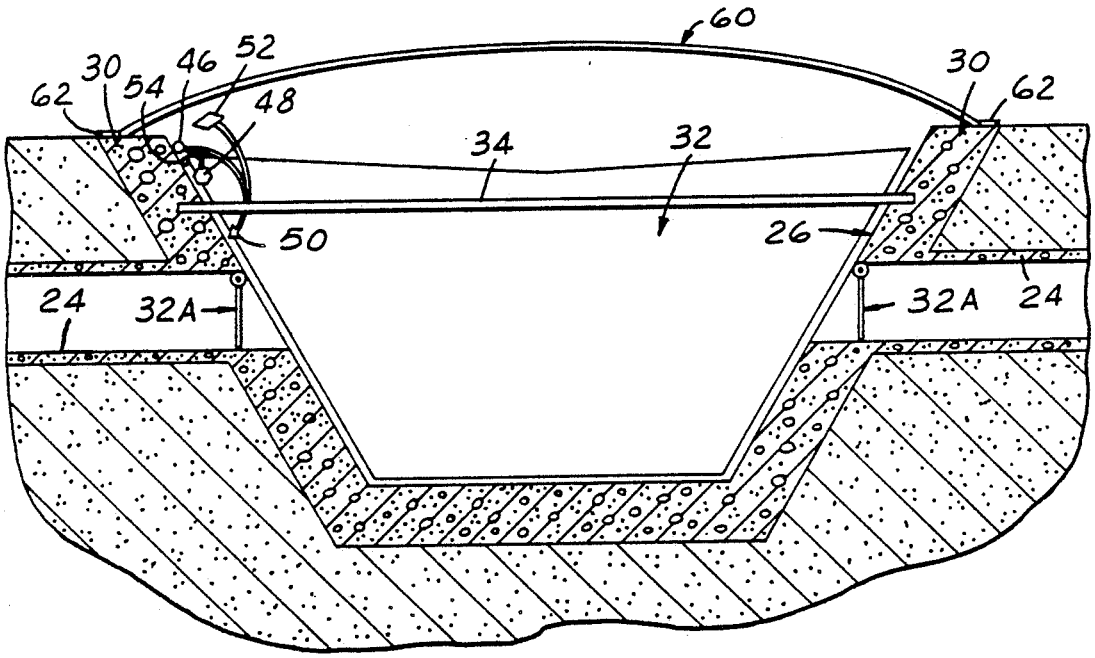
FIG. 5, an enlarged section on line 5—5 of FIG. 2.
Figure 7:
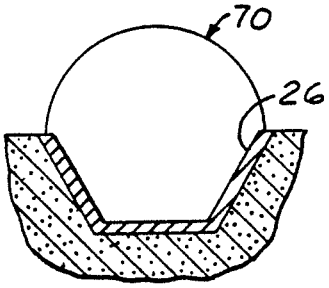
FIGS. 7, 8 and 9, sectional views of various drain channel covers to enclose an air passage.
Figure 8:
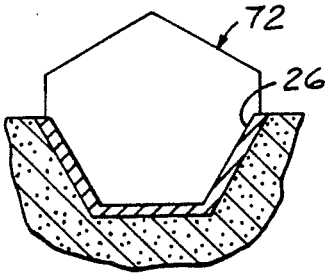
Figure 9:
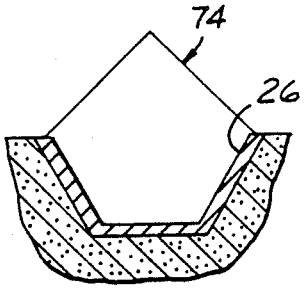

FIG. 5, a section on line 5—5 of FIG. 2, illustrates, diagrammatically, a section of a storm drain 26 which is normally open at the top. A trapezoidal section is lined with a concrete layer 30. An air flow channel damper 32 mounted on a pivot rod 34 is provided, this being in the closed position as illustrated.

In FIG. 5, a power cable 46 is associated with an anemometer 48 and a damper control 50. An air quality control sensor 52 is also included in a control circuit. A computer controlled communication cable 54 is also provided along side the power cable 46. A similar motorized damper, for the conduit, is employed to control air drawn from the conduit, dependent on a similar type sensor 52 placed adjacent the conduit to sample the conduit air. The dampers 32A would be modulated as a function of air pollution.

Over the top of the channel 26 is a flexible cover 60 anchored at the sides by fasteners 62. This cover will be provided with drain holes 64 (FIG. 5A) to allow rainfall to reach the channel. The cover may have spaced clear panels for sunlight illumination. However, the cover is otherwise opaque to block out sunlight to keep the channel cool. The cooling of the air increases its density, thus adding gravity boost to the air flow induced by the downstream air pump at the exhaust and filtering zone.

Figure 9A:
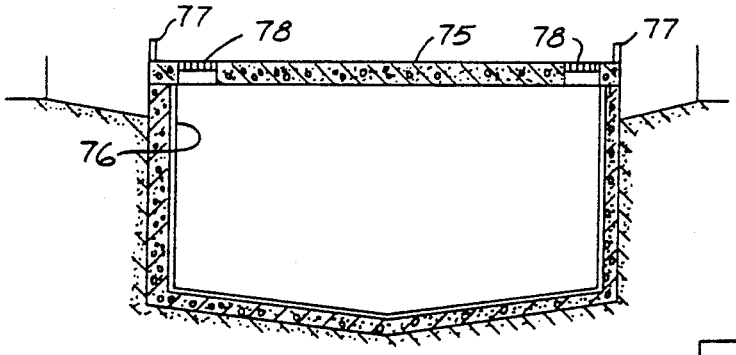
FIG. 9A, a drain cover with a utility roof for light vehicle traffic.

FIGS. 7, 8, 9 and 9A show, respectively, alternate roof shapes 70, 72 and 74 which increase the flow area. The flexible drainage cover 60 of FIG. 5 may be replaced, if new roadways are constructed. As shown in FIG. 9A, the cover 75 of a drain channel 76 is a reinforced roadway with guard rails 77 which can accommodate light vehicles or be used as a lineal park. An alternative cover could support solar energy collectors to provide electrical power at the multi-megawatt level as currently being done in California.

Figure 6:
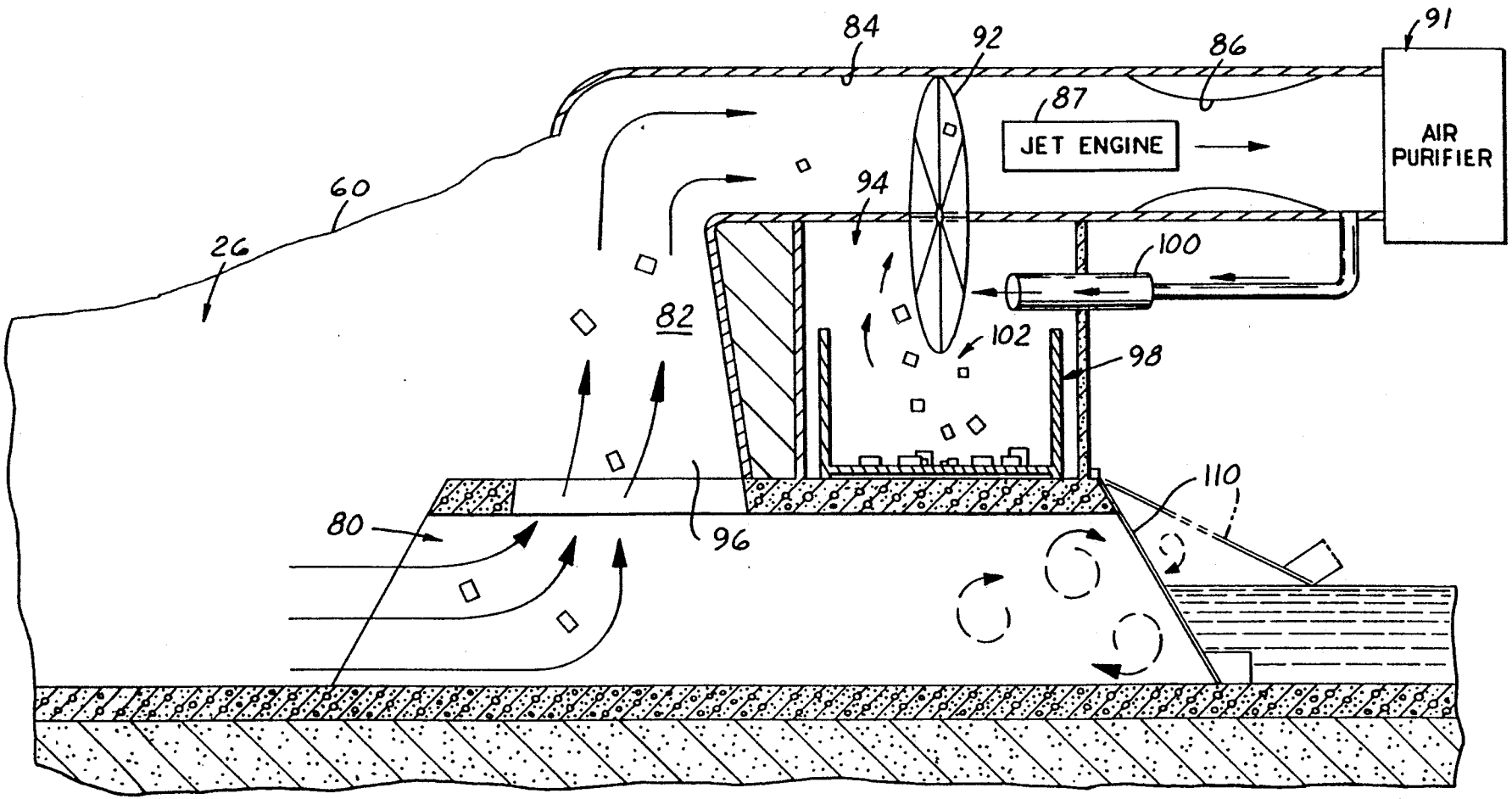
FIG. 6, a schematic view of an air discharge zone for an air and drain channel.

In FIG. 6, a collection and exhaust zone is illustrated. The channel 26 with the cover 60 is connected to a base chamber 80 with an upflow passage 82 leading to a horizontal tube 84, at one end of which is an aspirator venturi 86 driven by a high volume, aircraft type fan jet engine 87. At the turn from the passage 26 to the passages 82 and 84, the flowing air turns upward. With this change of direction, entrained dense debris can fall into the base chamber 80. Beyond the aspirator 86 is an air purifier 91 utilizing state-of-the-art anti-pollution systems.

Operating in the tube 84 is a circular, revolving filter disc screen 92, the upper portion of which is exposed to the air moving through a passage 84. The lower half of the filter disc screen is located in a separation bin 94. The filter disc screen 92 is a perforated member, such as a screen through which air can pass. Smaller entrained debris which does not separate at the up-turn 96 can be intercepted and removed by the filter disc.

A removable collector box 98 is located in chamber 94, and an air pipe 100 is connected to a source of air pressure and directed to the lower part of the filter wheel. This blast of air from pipe 100 clears debris from the filter disc screen so that it dumps at 102 by reverse flow for deposit into collector box 98. The slot in which the filter disc screen 92 rotates in the chamber 94 also returns the reverse flow of air to the air flow tube 84 to be processed.

At the right end of chamber 80 is a float controlled damper flap 110 which provides a downstream seal for the passages to act as a check valve on reverse flow possibilities. In some conditions, there will be water in the channels and the air will be moving above the water level. The damper flap 110 closes the downstream end of chamber 80. The float will be at the bottom of the chamber 80 when the chamber is dry. In an elevated position, the float will rest on the water surface in the system. Computer controlled override may be applied in special circumstances.

Large air moving blowers are known to be used for ventilating vehicular tunnels as, for example, the Lincoln and Holland Tunnels in New York. However, the fan jet type engine used in airplanes is considered feasible for the large air volume needed for a metropolitan area such as Los Angeles. Alternative engines are the turboprop engine of Allison, the prop fan of Pratt & Whitney and the unducted fan of General Electric. The number of engines and filter stations would depend on the module size, the area to be covered, and the local pollution generation level.

Figure 5A:
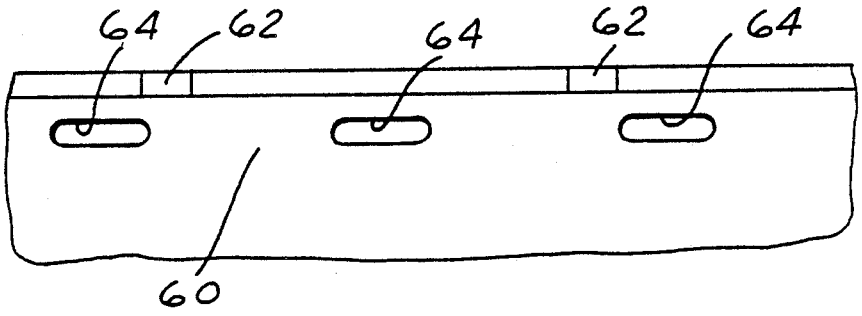
FIG. 5A, a top view of FIG. 5 to show drain openings.
Figure 7A:
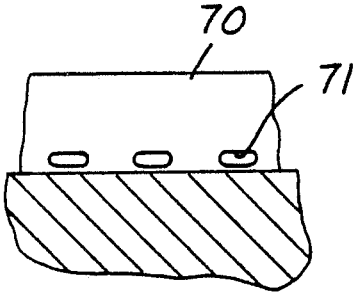
FIG. 7A, a side view of FIG. 7 to show drain openings.

The covers 60, 70, 72, 74 of the drain channels are provided with drain and air openings 64 and 71 designed to allow rain flow into the channels but will close the channels sufficiently that a reduced air pressure at one end will draw polluted air into the channels and carry it to the purifiers see FIGS. 5A and 7A. Various air filter systems may be used as the air is removed from the channels. The channel covers may be adjusted at the edges to receive polluted air in the area in which pollution is greatest and closed to a greater degree in other areas to maintain the needed air flow. The adjustment may be controlled by spot sensors of the degree of air pollution.

Figure 10:
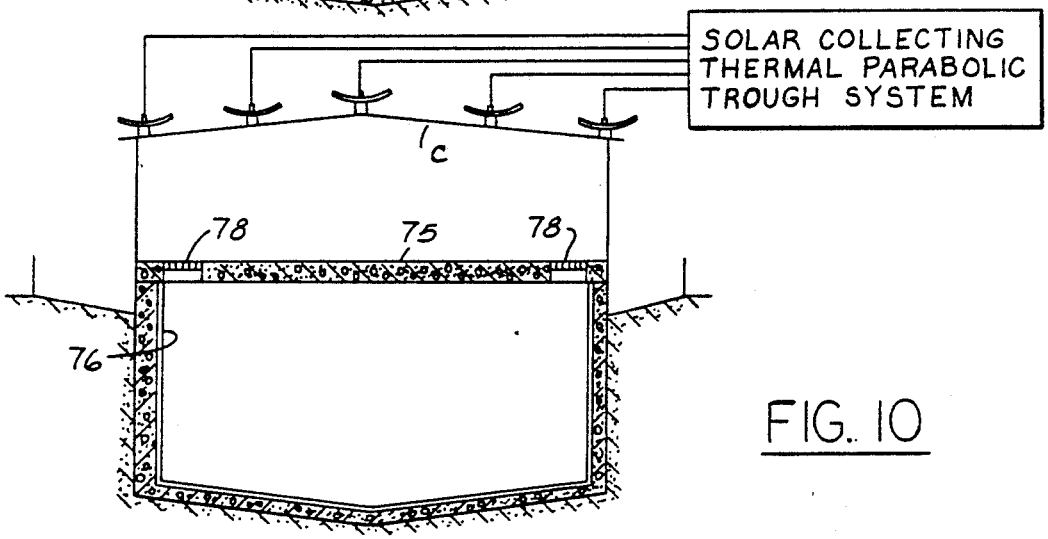
FIG. 10, a drain channel with a solar collector array supported by the cover.

In FIG. 10, a channel cover C has a series of solar collectors SC arranged on the top similar to those built by LUZ International in Southern California. These can produce pollution free megawatts of electricity to run the purification plants described in connection with FIG. 6. A covered roadway as in FIG. 10 would shield the commuter from the solar radiation being used to provide the megawatt power source. The extensive and appropriate location for the STORM DRAINAGE SYSTEM has the potential for also providing added roadways for light vehicles on the larger channels which could reduce highway gridlock. The emitted fumes can be drawn into the pollution collection system through roadway grills 78.

Figure 11:
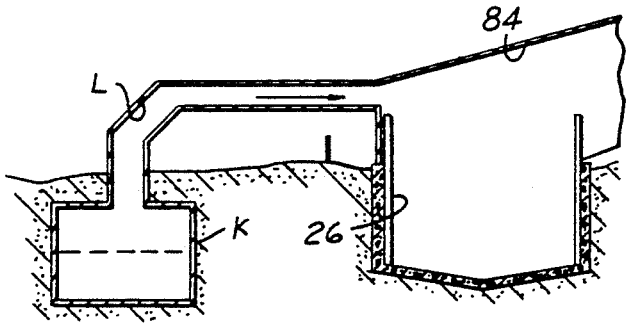
FIG. 11, a diagrammatic view of a system incorporating both storm and sanitary sewers for collecting polluted air.

In FIG. 11, a diagrammatic showing is directed to incorporating the pollution control system with a sewer system for joint operation. Air from a storm sewer K is drawn through an air duct L to a drain channel 26 (FIGS. 5 and 6) from which channel it will flow to the purification system passage 84 described in connection with FIG. 6.

The sanitary vents will add to the number of intake vents in the Air Purification System and the sanitary vents will no longer be a source of noxious fumes. The sanitary sewers will flow faster because of the enclosures and enable the system to handle greater volumes in order to meet area growth.

Figure 12:
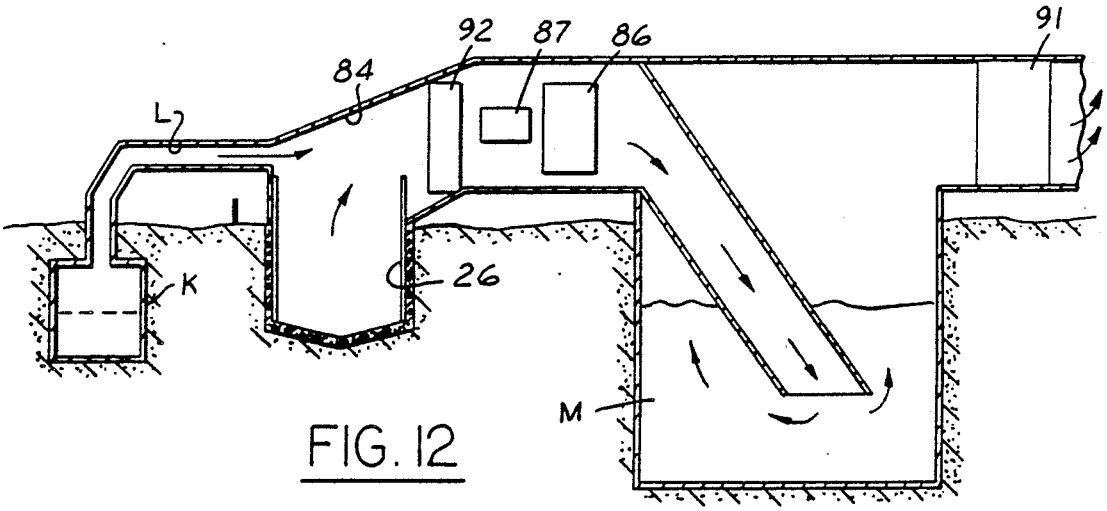
FIG. 12, a diagrammatic view of a system utilizing sludge as a wet filter.

In FIG. 12 is a diagrammatic showing of the combining of the Air Purification System with a sewage treatment plan. Air from the sewer channel K and the air channel 26 will pass through the clearing station shown in FIG. 6 and can then be directed to a sludge basin M which will serve as a constantly replaced filter. Then the air can pass to the purifier 91. This can also reduce sludge drying time in a sewage treatment plant.

The system then involves the following steps:

1. Polluted air enters the curb side storm drains 26 and through intake drain holes in the cover 60.
2. Air flows through the storm sewers to storm drainage channels.
3. Air in the drainage channels is pulled to the channel outlets 80, 82.
4. At the channel outlets air enters the air gathering ducts 84 and dense entrained debris is deposited in the drainage channel at 96.
5. The air duct 84 has revolving screens to catch lightweight debris and prevent passage to the jet-type engine intakes. The screens are cleared by a reverse flow air blast.
6. The polluted air is sucked into the jet-type engines.
7. The polluted air is then passed to a state-of-the art purification zone, using one, or a combination of the following filters or techniques:

(a) a charcoal filter bed
(b) a wet filter
(c) an electrostatic air filter
(d) other pollutant removing, or neutralizing devices.
(e) centrifugal separator,
(f) a chemical reaction.

8. The purified air is then discharged locally at ground level.

Figure 13:
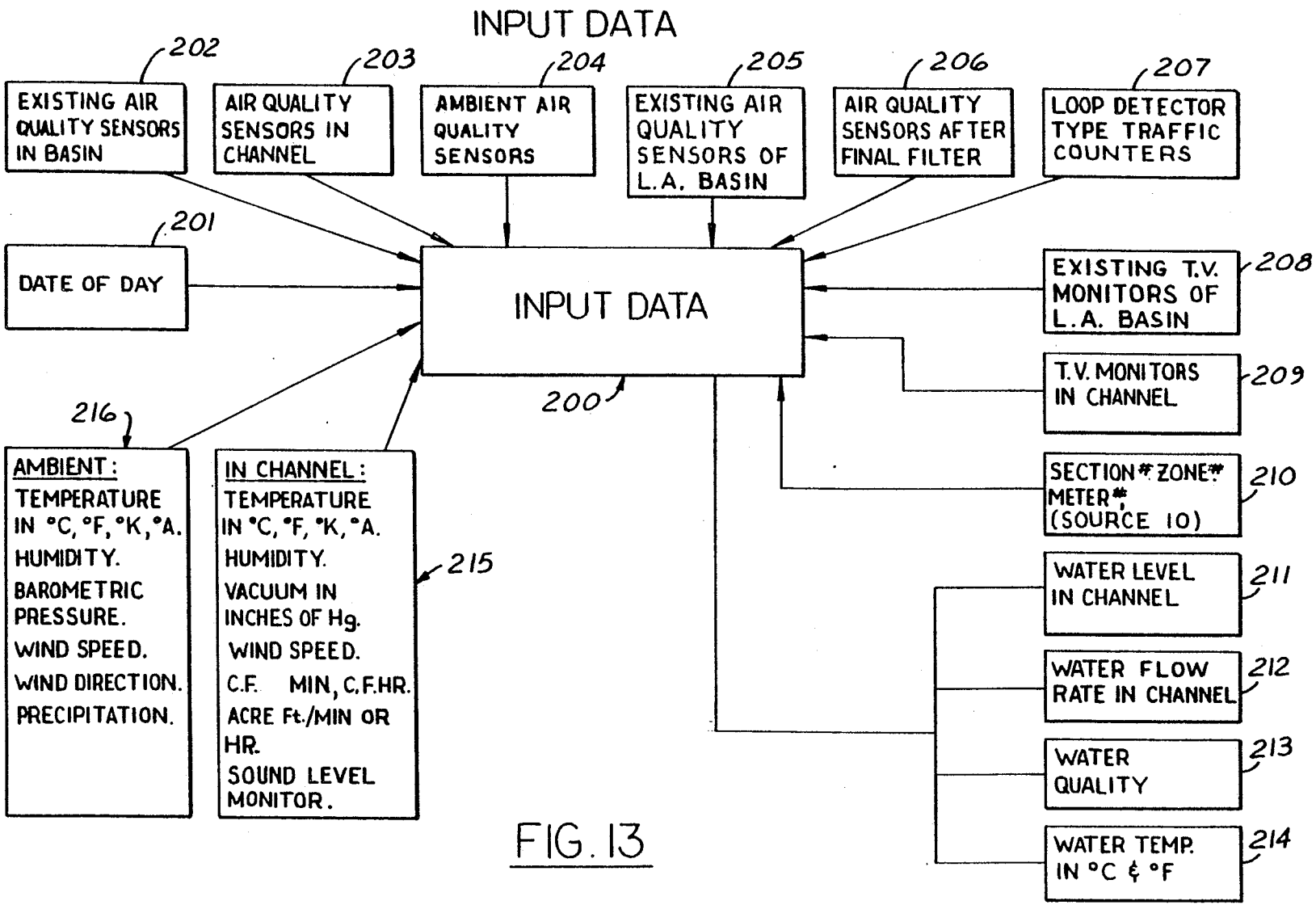
FIG. 13, a chart of input data to be used in a computerized control system.
Figure 14:
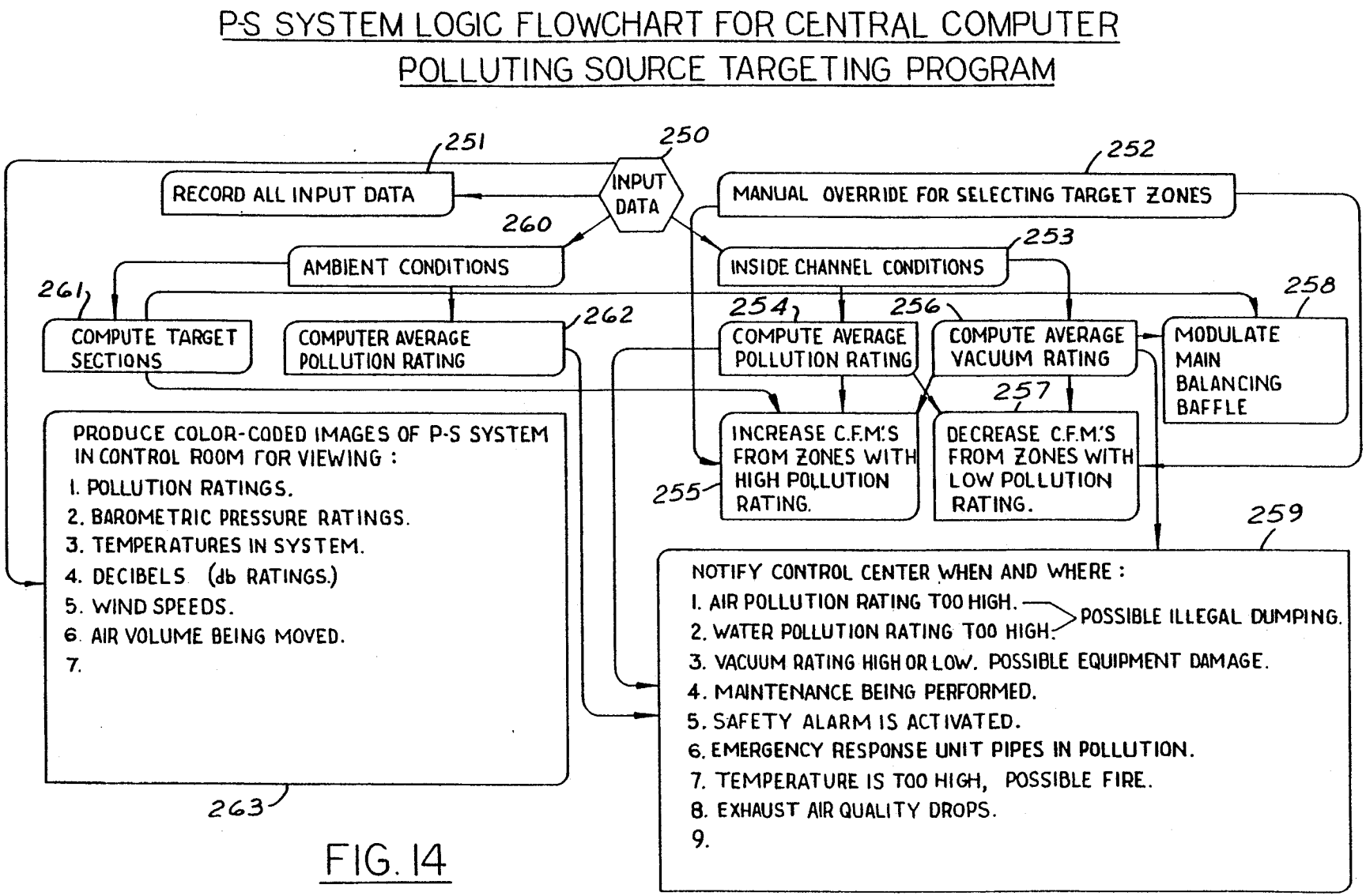
FIG. 14, a computerized system's logic flow chart for the central control computer polluting source targeting program.

Control devices consistent with modern electronic capabilities will be used to control the system. In FIG. 13, the input data block 200 receives input information from in-place, or added sensors, as illustrated by the drawing blocks as follows:

Block 201—Time and data
Block 202—Air quality sensors in the geographic basin
Block 203—Air quality sensors in the channels
Block 204—Air quality sensors on the channels
Block 205—Air quality sensors around the geographic basin being treated
Block 206—Air quality sensors after final filter
Block 207—Traffic counters in the area
Block 208—Television monitors around the basin
Block 209—Television monitors in the channels
Block 210—Location zones
Block 211—Water level in channel
Block 212—Water volume in channel
Block 213—Water quality in channel
Block 214—Water temperature in channel
Block 215—Physical conditions in channel
Block 216—Ambient physical conditions In FIG. 14, a block diagram of the Air Pollution System (APS) shows the distribution at 250 of the INPUT DATA 200 depicted in FIG. 10 and listed above. The block descriptions are self-explanatory but consist in general as:

Block 251—Recording Data
Block 252—Manual override for selecting target zones
Block 253—Inside channel conditions
Block 254—(a) Compute Average Pollution Rating
Block 255—(b) Increase flow (CFM) in high pollution zones
Block 256—(c) Compute Average Vacuum Rating
Block 257—(d) Decrease flow (CFM) in low pollution zone
Block 258—(e) Modulate Main Balance
Block 259—Notification Control Center
Block 260—Ambient Conditions
Block 261—Compute Target Sections to be monitored and controlled
Block 262—Compute Average Pollution Rating
Block 263—Produce Color-Coded Images of Systems in Control Room for viewing of charged items The central control illustrated in FIG. 14 can selectively program the level of intensive module action for response to locales having higher concentration of pollution. The programming can be activated in anticipation of start-up of predictable services, e.g., time-of-day on the freeways and in industries, major public gatherings, etc.

There is thus disclosed a method for utilizing existing (or to be constructed) water drain systems in high air pollution areas for moving polluted air to the drain channels and thence to clearing and cleaning areas where anti-pollution filters may be employed to purify the air before discharge to the atmosphere.

What is claimed as new is as follows:

1. A system for collecting and purifying polluted air in an urban geographic area subject to smog conditions and high volume automotive traffic at spaced intervals in a 24-hour day, (a) utilizing a plurality of open water draining which channels in an urban collection area, which channels are arranged in a flow pattern to carry rainfall water to a discharge area,
(b) installing covers over said open channels to enclose said open channels to provide an elongate air passage in said channels,
(c) providing side passages in said covers to admit drainage water into said channels and to meter polluted air into said channels in response to an induced sub-atmospheric pressure in said channels,
(d) providing a high volume of a jet engine of airplane capacity to create sub-atmospheric pressure in said channels and carry air in said channels to a converging area of said channels, and
(e) providing a depollution apparatus for said air prior to discharge at a site remote from the collection area in which said channels are located.

2. In a system as defined in claim 1 in which said depollution apparatus has an entrance chamber rising abruptly from a drainage channel to an air inducing passage to cause entrained objects to dump by gravity downward to a receiving bin.

3. A system as defined in claim 2 in which a moving filter screen is positioned in said air inducing passage to remove entrained particles from air passing through said apparatus.

4. A system as defined in claim 2 in which air from said entrance chamber is directed through a volume of moving sludge in a sludge basin to be further filtered.

* * * * *